US010611173B2

(12) United States Patent
Martin et al.

(10) Patent No.: US 10,611,173 B2
(45) Date of Patent: Apr. 7, 2020

(54) FLUID EJECTION DEVICE WITH FIRE PULSE GROUPS INCLUDING WARMING DATA

(71) Applicant: HEWLETT-PACKARD DEVELOPMENT COMPANY, L.P., Fort Collins, CO (US)

(72) Inventors: Eric Martin, Corvallis, OR (US); Vincent C Korthuis, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/318,205

(22) PCT Filed: Oct. 26, 2016

(86) PCT No.: PCT/US2016/058878

§ 371 (c)(1),
(2) Date: Jan. 16, 2019

(87) PCT Pub. No.: WO2018/080480

PCT Pub. Date: May 3, 2018

(65) Prior Publication Data

US 2019/0283449 A1 Sep. 19, 2019

(51) Int. Cl.
*B41J 2/35* (2006.01)
*B41J 2/355* (2006.01)
(Continued)

(52) U.S. Cl.
CPC ..... *B41J 2/3556* (2013.01); *B41J 2/0458* (2013.01); *B41J 2/04528* (2013.01);
(Continued)

(58) Field of Classification Search
CPC ... B41J 2/35; B41J 2/355; B41J 2/3556; B41J 2/38; B41J 2/04543; B41J 2/0458;
(Continued)

(56) References Cited

U.S. PATENT DOCUMENTS 5,999,204 A * 12/1999 Kojinna ..... B41J 2/365 347/190
6,494,555 B1 12/2002 Ishikawa
(Continued)

FOREIGN PATENT DOCUMENTS

WO WO-2005105455 A1 11/2005
WO WO-2015080709 A1 6/2015
(Continued)

OTHER PUBLICATIONS

Lemeunier F. K. et al, Experimental Investigation and Numerical Modeling of the Thermal Behavior of a Micro-heater, Nov. 23, 2014, <http://link.springer.com/article/10.1007/s00542-014-2373-7>.

*Primary Examiner* — Kristal Feggins
(74) *Attorney, Agent, or Firm* — HP Inc. Patent Department

(57) ABSTRACT

A fluid ejection device including a plurality of primitives each having a same set of addresses and including a plurality of fluid chambers, each fluid chamber corresponding to a different address of the set of addresses and including a firing mechanism. Input logic receives a series of fire pulse groups, each fire pulse group corresponding to an address of the set of addresses and including warming data having an enable value or a disable value and a series of firing bits, each firing bit corresponding to a different primitive and having a firing value or a non-firing value. For each firing bit of each fire pulse group, when the warming data has the enable value, activation logic provides a warming pulse to
(Continued)

the firing mechanism of the fluid chamber corresponding to the firing bit when the firing bit has the non-firing value.

15 Claims, 10 Drawing Sheets

(51) Int. Cl.
*B41J 2/045* (2006.01)
*B41J 2/005* (2006.01)
*B41J 2/14* (2006.01)

(52) U.S. Cl.
CPC ..... *B41J 2/04543* (2013.01); *B41J 2/04563* (2013.01); *B41J 2/04598* (2013.01); *B41J 2002/0055* (2013.01); *B41J 2002/14467* (2013.01); *B41J 2202/12* (2013.01)

(58) Field of Classification Search
CPC ..... B41J 2/04598; B41J 2/04563; B41J 2/04528; B41J 2202/12; B41J 2002/14467; B41J 2002/0055
See application file for complete search history.

(56) References Cited

U.S. PATENT DOCUMENTS

| | | | | |
|---|---|---|---|---|
| 6,601,936 | B2 * | 8/2003 | McDonald | B41J 2/04528 347/14 |
| 7,815,277 | B2 | 10/2010 | Yamada | |
| 8,009,184 | B2 * | 8/2011 | Saquib | B41J 2/365 347/195 |
| 8,348,373 | B2 | 1/2013 | Martin et al. | |
| 8,991,983 | B2 | 3/2015 | Hager et al. | |
| 9,138,991 | B2 | 9/2015 | Murase et al. | |
| 9,162,453 | B2 | 10/2015 | Cruz-Uribe et al. | |
| 2006/0109337 | A1 * | 5/2006 | Jo | B41J 2/365 347/185 |

FOREIGN PATENT DOCUMENTS

| | | | |
|---|---|---|---|
| WO | WO-2015191060 | A1 | 12/2015 |
| WO | WO-2016068898 | A1 | 5/2016 |
| WO | WO-2016089371 | A1 | 6/2016 |
| WO | WO-2016130157 | A1 | 8/2016 |

* cited by examiner

FLUID EJECTION DEVICE WITH FIRE PULSE GROUPS INCLUDING WARMING DATA

BACKGROUND

Fluid ejection devices typically include a number of fluid chambers, or firing chambers, which are arranged in columns, with each column being disposed along a fluid slot, and with each fluid chamber being in fluid communication with and receiving fluid from the fluid slot via fluid passages. Typically, fluid chambers are one of two types, referred to generally as ejection chambers or non-ejection chambers. Ejection chambers, also referred to as "drop generators" or simply as "nozzles", include a nozzle and a fluid ejector, such as a firing resistor, that, when energized, causes a drop of fluid to be ejected from the nozzle. Non-ejection chambers, also referred to as "recirculating pumps" or simply as "pumps", also include a fluid ejector, but do not include a nozzle. When energized, the fluid ejector pumps or recirculates fluid through corresponding fluid passages from the fluid slot to keep associated nozzles supplied with fresh fluid. In some instances, there is a 1-to-1 relationship between nozzles and pumps (i.e., one pump associated with each nozzle).

DETAILED DESCRIPTION

Figure 1:
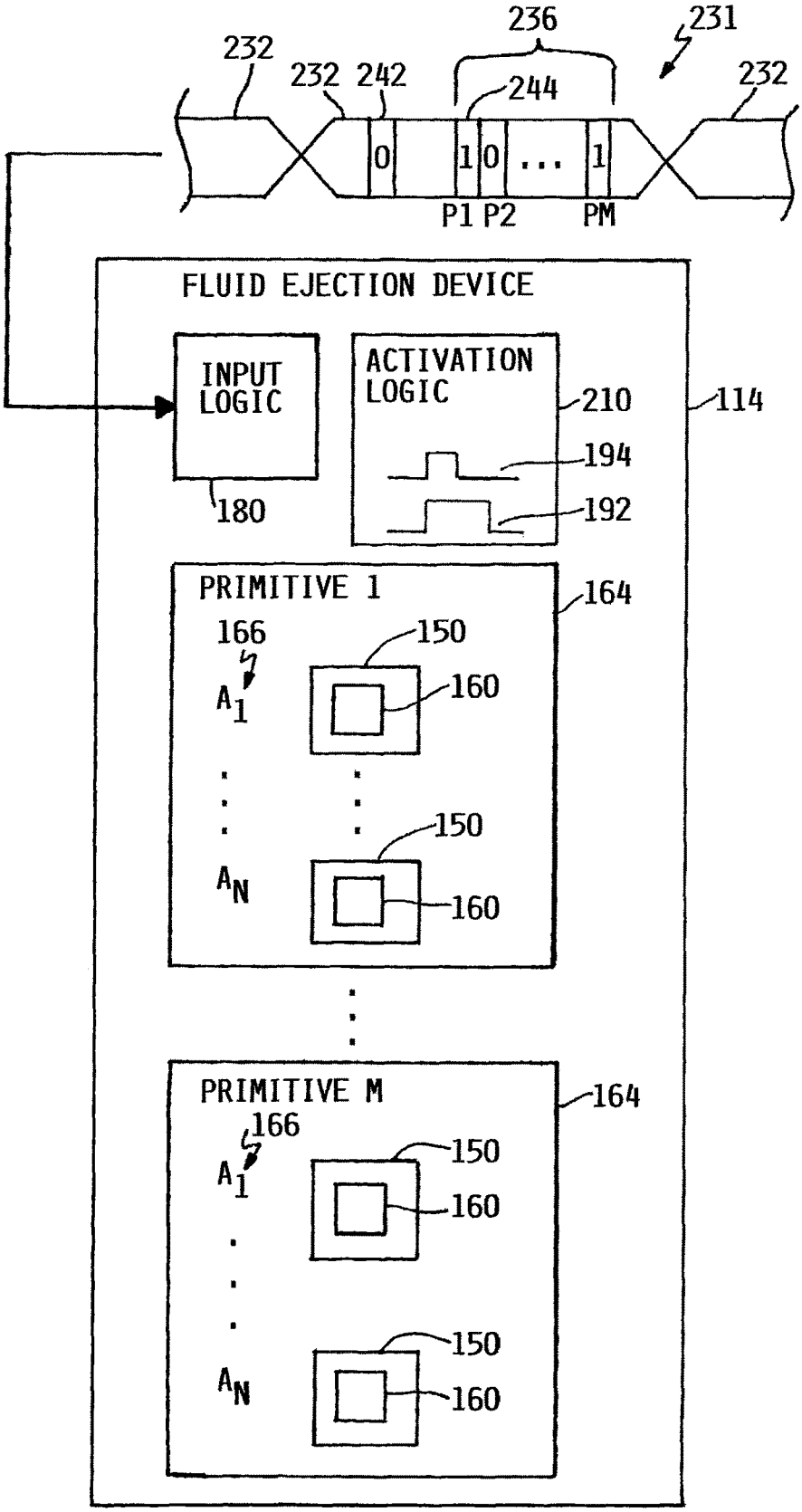
FIG. 1 is a block and schematic diagram generally illustrating a fluid ejection device with fire pulse groups including warming data, according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Fluid ejection devices typically include a number of fluid chambers, often arranged in columns, with each column being disposed along a fluid slot, and with each fluid chamber being in fluid communication with and receiving fluid from the fluid slot via fluid passages. Typically, fluid chambers are one of two types, referred to generally as ejection chambers and non-ejection chambers. Ejection chambers, also referred to as "drop generators" or simply as "nozzles", include a nozzle and a fluid ejector, such as a firing resistor, for example, that, when energized, causes a drop of fluid to be ejected from the fluid chamber through the nozzle. Non-ejection chambers, also referred to as "recirculating pumps" or simply as "pumps", also include a fluid ejector, but do not include a nozzle. When energized, the fluid ejector pumps or recirculates fluid through corresponding fluid passages from the fluid slot to keep nozzles supplied with fresh fluid. In some instances, there is a 1-to-1 relationship between nozzles and pumps (i.e., one pump associated with each nozzle).

Fluid ejection devices are typically maintained at a minimum or default temperature during operation (for example, at 55° C.). If a nozzle has been inactive for a predetermined time prior to ejecting fluid (e.g., ink), the pump (or pumps) associated with the nozzle is energized to recirculate fresh fluid to the nozzle prior to ejecting fluid. In some cases a pump may be "pumped" (e.g., a firing resistor is energized) up to 1,000 times prior to the nozzle ejecting fluid. Such pumping causes the fluid and adjacent portions of the fluid ejection device to increase in temperature.

If a group or zone of physically adjacent pumps are simultaneously pumping in preparation for ejection of fluid by associated nozzles, the given zone of heavy fluid recirculation of the column of fluid chambers will become elevated in temperature relative to other regions of the column. As a result of these thermal gradients, nozzles in the zone of heavy recirculation will eject larger fluid drops (i.e., having a larger volume) than nozzles in cooler zones of the column that are ejecting fluid without recirculation (e.g., a zone of nozzles that was previously recirculated and has been cooled by the ejection of fluid drops). In a case where the fluid ejection device is implemented as inkjet printhead, the difference in ink drop sizes being ejected from different zones of the column will produce an undesirable striping or banding effect in a printed image, with areas of the images produced by the warmer zones of the column of nozzles being darker than those produced by cooler zones of the column of nozzles.

FIG. 1 is a block and schematic diagram generally illustrating a fluid ejection device 114, according to one example of the present disclosure. Fluid ejection device 114 includes a plurality of primitives 164, illustrated as primitives P1 to PM, with each primitive 164 including a plurality of fluid chambers 150, with each fluid chamber 150 corresponding to a different address of a set addresses 166, illustrated as addresses A1 to AN, and each having a fluid ejector 160, such as a firing resistor 160, for example.

Input logic 180 receives a series 231 of fire pulse groups (FPGs) 232, with each FPG 232 including warming data 242 having an enable value or a disable value and a series 236 of ejection or firing bits 244, each firing bit 244 corresponding to a different on the of the primitives P1 to PM and each having an ejecting or firing value (e.g., a value of "1") and a non-ejecting or non-firing value (e.g., a value of "0").

For each firing bit 244 of each FPG 232, when the warming data 242 has the enable value (e.g., a value of "1"), activation logic 210 provides a warming pulse 194 (see also FIG. 4) to firing resistor 160 (or other thermal fluid ejector) of the fluid chamber 150 corresponding to the firing bit 244 when the firing bit has the non-firing value (e.g., a value of "0"), and when a temperature of the plurality of primitives P1 to PM is at least equal to a default temperature (e.g., a desired minimum operating temperature) of fluid ejection device 114 and less than a warming temperature. In one example, for each firing bit 244 of each FPG 232, when the warming data 242 has the enable value, activation logic 210 provides a firing pulse 192 (see also FIG. 4) to firing resistor 160 of the fluid chamber 150 corresponding to the firing bit 244 when the firing bit has the firing value.

As will be described in greater detail below, by warming non-circulating pumps and/or non-ejecting fluid chambers 150 via warming data included in FPGs, in accordance with the present disclosure, thermal gradients across primitives 164 of fluid ejection device 114 are reduced and/or eliminated, thereby reducing variations in the volume of fluid drops ejected by fluid chambers 150. In a case where fluid ejection device 114 is implemented as an inkjet printhead 114, reducing or eliminating thermal gradients across inkjet printhead 114 reduces or eliminates banding in printed images.

Figure 2:
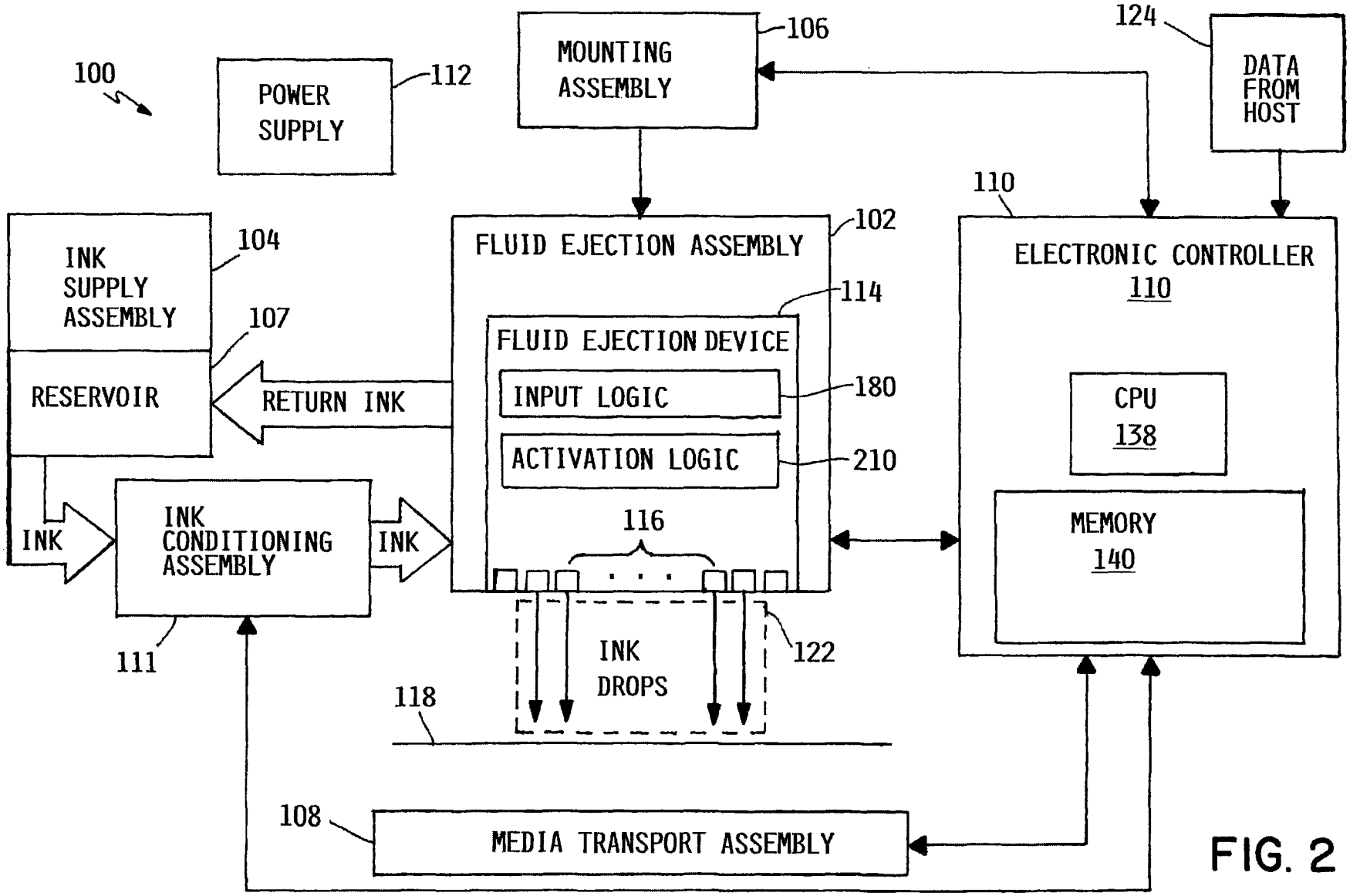
FIG. 2 is a block and schematic diagram illustrating a fluid ejection system including a fluid ejection device with nozzle column data groups including warming data, according to one example.

FIG. 2 is a block and schematic diagram illustrating generally an example of a fluid ejection system 100 having a fluid ejection assembly 102 including a fluid ejection device 114, such as an inkjet printhead 114, for instance, including a number of ink chambers (i.e., both nozzles and pumps), and having a warming system, in accordance with the present disclosure, which includes warming operations data along with firing data during printing operations to cause non-circulating pumps and/or non-printing nozzles to warm when a pending zone of heavy recirculation is identified.

In addition to fluid ejection assembly 102 and fluid ejection device 114, fluid ejection system 100 includes a fluid supply assembly 104 including fluid storage reservoir 107, a mounting assembly 106, a media transport assembly 108, an electronic controller 110, and at least one power supply 112 that provides power to the various electrical components of fluid ejection system 100.

Fluid ejection assembly 114, in accordance with the present disclosure, includes input logic 180 and activation logic 210, such as described above with reference to FIG. 1, and ejects drops of fluid through a plurality of orifices or nozzles 116, such as onto print media 118 so as to print onto print media 118 when implemented as a fluid drop ejecting inkjet printhead 114. In one example, nozzles 116, together with associated pumps (not illustrated) are arranged in one or more columns or arrays, with groups of nozzles and pumps being organized to form primitives, and the primitives arranged into primitive groups (e.g., columns of primitives). When implemented as an inkjet printhead, properly sequenced ejections of ink drops from nozzles 116 result in characters, symbols or other graphics or images being printed on print media 118 as inkjet printhead assembly 102 and print media 118 are moved relative to one another.

While broadly described herein with regard to a fluid ejection system 100 employing a fluid ejection device 114, fluid ejection system 100 may be implemented as a drop-on-demand thermal inkjet printing system with inkjet printhead 114 being a thermal inkjet (TIJ) printhead 114, wherein a warming system and the inclusion of warming operations data together with energization data, according to the present disclosure, can be implemented in other printhead types as well, such wide array of TIJ printheads 114 and piezoelectric type printheads, for example. Furthermore, the warming system and inclusion of warming operations data together with energization data, in accordance with the present disclosure, is not limited to inkjet printing devices, but may be applied to any digital dispensing device, including 2D and 3D printheads (forming 3D articles), for example.

In operation, fluid typically flows from reservoir 107 to fluid ejection assembly 102, with fluid supply assembly 104 and fluid ejection assembly 102 forming either a one-way fluid delivery system or a recirculating fluid delivery system. In a one-way fluid delivery system, all of the fluid supplied to fluid ejection assembly 102 is consumed during fluid ejecting operations. However, in a recirculating fluid delivery system, only a portion of the fluid supplied to fluid ejection assembly 102 is consumed during fluid ejection operation, with fluid not consumed during fluid ejecting operation being returned to supply assembly 104. Reservoir 107 may be removed, replaced, and/or refilled.

In one example, fluid supply assembly 104 supplies fluid under positive pressure through a fluid conditioning assembly 11 to fluid ejection assembly 102 via an interface connection, such as a supply tube. Fluid supply assembly 104 includes, for example, a reservoir, pumps, and pressure regulators. Conditioning in the fluid conditioning assembly may include filtering, pre-heating, pressure surge absorption, and degassing, for example. Fluid is drawn under negative pressure from fluid ejection assembly 102 to the fluid supply assembly 104. The pressure difference between an inlet and an outlet to fluid ejection assembly 102 is selected to achieve correct backpressure at nozzles 116.

Mounting assembly 106 positions fluid ejection assembly 102 relative to media transport assembly 108, and media transport assembly 108 positions media 118 relative to fluid ejection assembly 102, so that an ejection zone 122 is defined adjacent to nozzles 116 in an area between fluid ejection assembly 102 and media 118. In one example, fluid ejection assembly 114 is implemented as an inkjet printhead assembly 102 and is a scanning type printhead assembly. According to such example, mounting assembly 106 includes a carriage for moving inkjet printhead assembly 102 relative to media transport assembly 108 to scan printhead 114 across media 118. In another example, inkjet printhead assembly 102 is a non-scanning type printhead assembly. According to such example, mounting assembly 106 maintains inkjet printhead assembly 102 at a fixed position relative to media transport assembly 108, with media transport assembly 108 positioning media 118 relative to inkjet printhead assembly 102.

Electronic controller 110 includes a processor (CPU) 138, a memory 140, firmware, software, and other electronics for communicating with and controlling fluid ejection assembly 102, mounting assembly 106, and media transport assembly 108. Memory 140 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for fluid ejection system 100.

In one example, electronic controller 110 receives data 124 from a host system, such as a computer, and temporarily stores data 124 in a memory. Typically, data 124 is sent to fluid ejection system 100 along an electronic, infrared, optical, or other information transfer path. In one example, when fluid ejection system 100 is implemented as an inkjet printing system 102, data 124 represents, for example, a document and/or file to be printed, where data 124 forms a print job for inkjet printing system 100 and includes one or more print job commands and/or command parameters.

In one implementation, electronic controller 110 controls fluid ejection assembly 102 for ejection of fluid drops from nozzles 116 of fluid ejection devices 114. Electronic controller 110 defines a pattern of ejected fluid drops to be ejected from nozzles 116, and which together, in a case when implemented as an inkjet printing system 100, form characters, symbols, and/or other graphics or images on print media 118 based on the print job commands and/or command parameters from data 124.

In one example of the present disclosure, as will be described in greater detail below, electronic controller 114 provides energization or firing data to fluid ejection assembly 102 in the form of a series of nozzle column groups (NCGs), with each NCG including a series of fire pulse groups (FPGs), and each FPG including ejection or firing data which controls the fluid ejectors (e.g., firing resistors) of pumping chambers and of nozzles 114 to eject a defined pattern of fluid drops. According to one example, as will be described in greater detail below, the PCGs include warming data to direct warming of fluid ejection assembly 102 in accordance with the present disclosure.

Figure 3A:
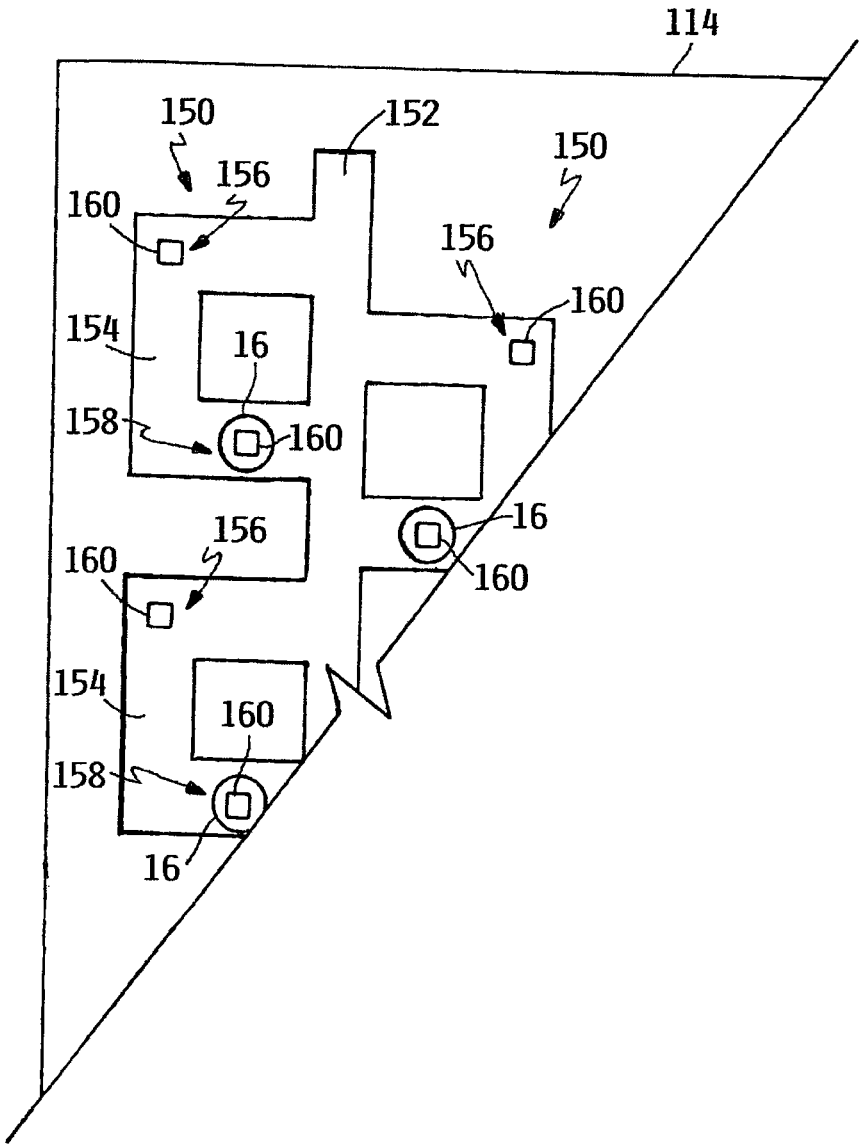
FIG. 3A is a block and schematic diagram generally illustrating a portion of a fluid ejection device, according to one example.

FIG. 3A is a block and schematic diagram generally illustrating an example of a portion of fluid ejection device 114. Fluid ejection device 114 includes a plurality of fluid chambers 150 in communication with a fluid slot 152 via fluid passages or channels 154. Fluid chambers 150 include non-ejection chambers (or pumps) 156 and ejection chambers (or nozzles) 158, with pumps 156 and nozzles 158 both including drop ejectors 160 (e.g., firing resistors), and nozzles 158 further including a nozzle (or orifice) 16 through which fluid drops are ejected.

Figure 3B:
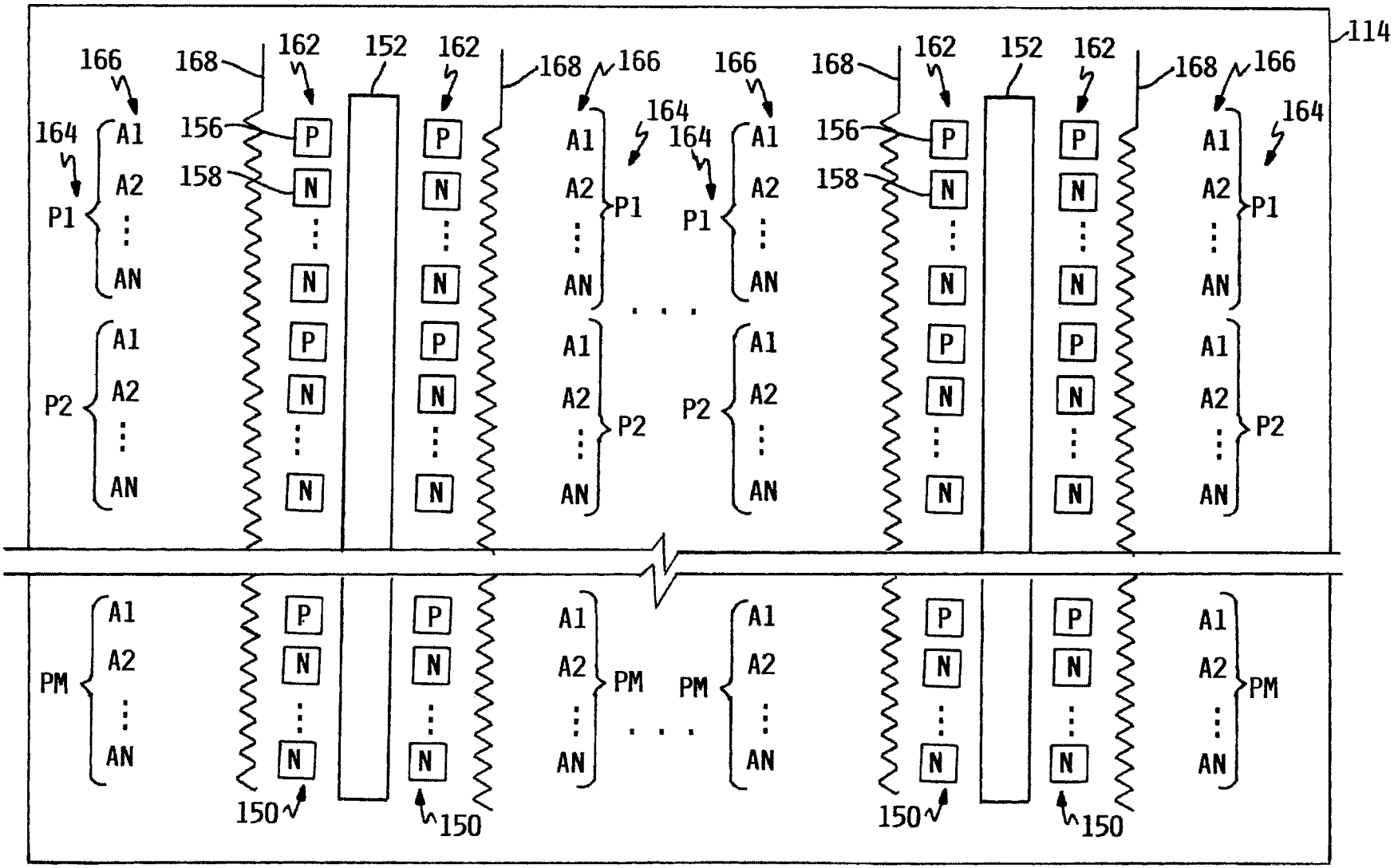
FIG. 3B is a block and schematic diagram generally illustrating portions of a fluid ejection device, according to one example.

FIG. 3B is a block and schematic diagram generally illustrating a fluid ejection device 114, according to one example. Fluid ejection device 114 includes a number of fluid slots 152, with each fluid slot 152 having a column 162 of fluid chambers 150 arranged on each side thereof, with each column 162 including a number of pumps 156 and nozzles 158. In one example, when fluid ejection device 114 is implemented as an inkjet printhead, each fluid slot 152 may supply a different color on ink to fluid chambers 150. While illustrated as being arranged in columns along fluid slots, fluid chambers 150 and primitives 180 may be arranged in other configurations, such as in an array where the fluid slot 154 is replaced with an array of fluid feed holes, for instance.

In one example, fluid chambers 150 of each column 152 are grouped to form a plurality of primitives 164, illustrated at primitives P1 to PM, with each primitive 164 receiving a same set of addresses 166, illustrated as addresses A1 to AN, with each fluid chamber 150 of each primitive 164 corresponding to one address of the set of addresses 166. In one example, each primitive 164 has a same number of pumps 156 as nozzles 158 (i.e., a 1-to-1 ratio), with pumps 156 corresponding to odd-numbered addresses (e.g., A1, A3 . . . AN−1) and nozzle corresponding to even-number addresses (e.g., A2, A4 . . . AN). In other examples, pumps 156 and nozzles 158 have a ratio other than 1-to-1 and are not assigned to odd and even addresses. Although each primitive is illustrated as having a same number, N, of fluid chambers 150, it is noted that the number of fluid chambers 150 can vary from primitive to primitive.

In one example, each column 162 has at least one corresponding temperature sensing element 168. In one case, temperature sensing element 168 extends the length of the column and provides an average temperature of the column 162 of fluid chambers 150. In one instance, sensing element 168 is a thermal resistor.

Figure 4:
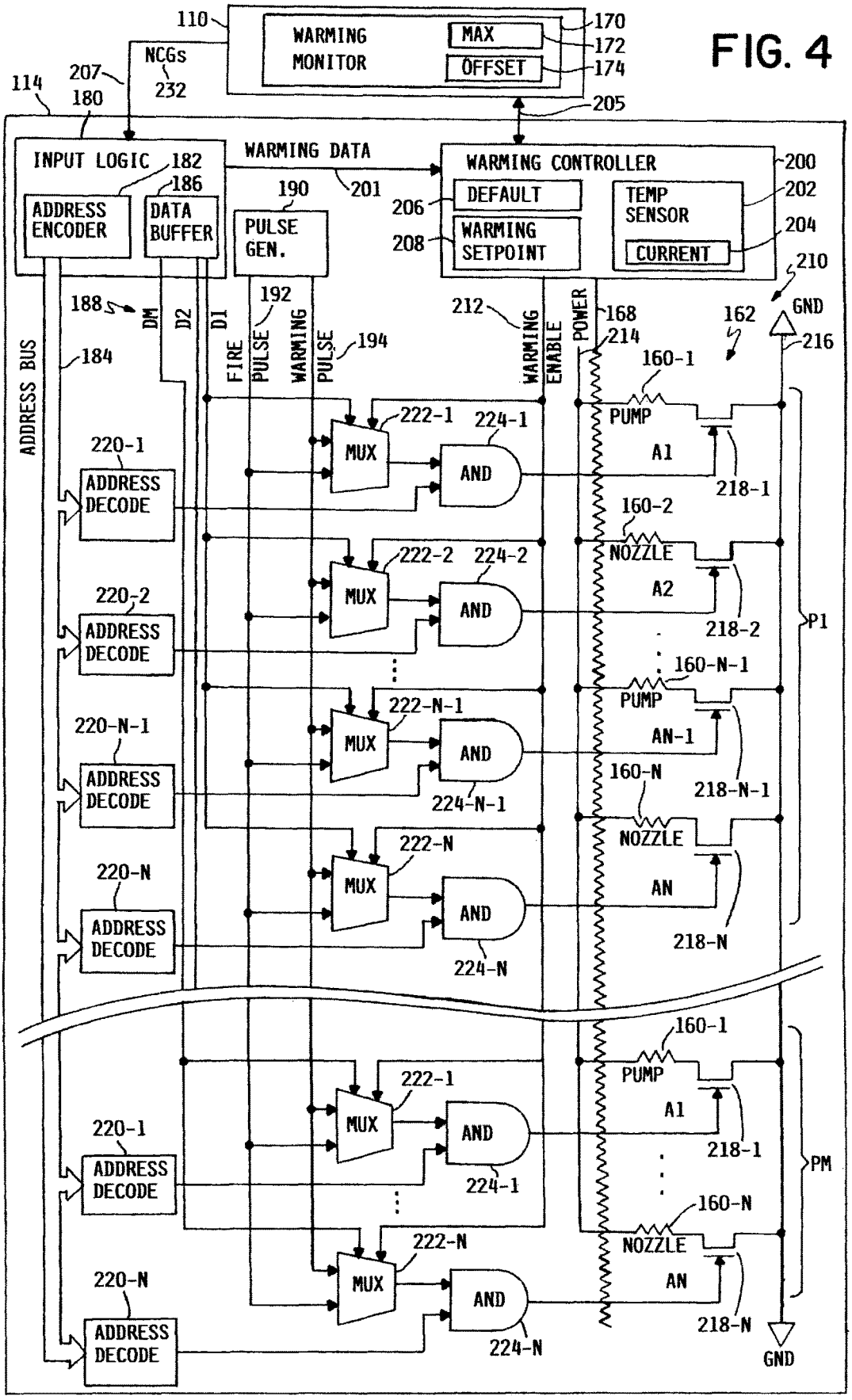
FIG. 4 is a block and schematic diagram illustrating generally portions of an example of a fluid ejection system including a controller and fluid ejection device, according to one example.

FIG. 4 is a block and schematic diagram generally illustrating portions of fluid ejection system 100 including an electronic controller 110 and fluid ejection device 114 employing a warming system to reduce or eliminate thermal gradients in fluid ejection device 114 during fluid ejection operations, in accordance with the present disclosure. According to one example, electronic controller 110 includes a warming monitor 170 having a maximum temperature setpoint 172 and an offset temperature value 174. In one example, maximum temperature setpoint 172 and offset temperature value 174 are stored values which able to be set by a user during operation of fluid ejection system 100. As will be described in greater detail below, according to one example, warming monitor 170 monitors firing data to identify pending zones of heavy recirculation on fluid ejection device 114 and, when such zones are identified, includes warming operations data along with the firing data sent to fluid ejection device 114 to cause non-circulating pumps 156 and/or non-ejecting nozzles 158 to warm, without firing, so as to increase the temperature of all zones of the fluid ejection device 114 to a warming setpoint temperature (e.g., equal to a sum of the current temperature of the fluid ejection device and offset temperature value 174) and thereby reduce and/or eliminate undesirable thermal gradients.

Fluid ejection device 114 includes a column of fluid chambers 150 grouped to form a number of primitives 162, illustrated as primitives P1 to PM. Each primitive includes a number of fluid chambers 150, including a number pumps 156 and a number of nozzles 158, with each pump 156 and nozzle 158 including a firing mechanism 160. In one case, firing mechanism 160 is a thermal firing mechanism, such as a firing resistor 160, for example. In the illustrated example, each primitive has same set of addresses 166, illustrated as addresses A1 to AN, with each fluid chamber 150 of each primitive corresponding to a different one of the addresses of the set of addresses.

Fluid ejection device 114 includes input logic 180 having an address encoder 182 which encodes addresses of the set of addresses 166 on an addresses bus 184, and a data buffer 184 which places energization data for firing mechanisms 160 received from electronic controller 110 in the form of NCGs (nozzle column groups and FPGs (fire pulse groups), see FIGS. 5 and 6 below, on a number of data lines 188, illustrated as data lines D1 to DM, with one data line corresponding to each primitive P1 to PM.

A pulse generator 190 generates a fire pulse on a fire pulse line 192 and a warming pulse on a warming pulse line 194.

As described below, a fire pulse causes a selected firing mechanism 160 to be energized for a duration that causes a fluid drop being ejected in the case of a nozzle 158 and fluid to be circulated in the case of a pump 156 (i.e., enables a drive bubble to form and collapse). In contrast, a warming pulse causes a selected fluid ejector to be energized for a duration that enables the fluid ejector (e.g., a firing resistor) to heat the corresponding fluid chamber, but without causing a fluid drop to be ejected in the case of a nozzle 158 or fluid to be circulated in the case of pump 156.

A warming controller 200 includes a temperature sensor 202 which is in electrical communication with temperature sensing element 168 corresponding to the column of fluid chambers 162. In one example, as described above, temperature sensing element 168 is a thermal resistor 168 extending a length of the column of fluid chambers 262. In one example, temperature sensor 202 provides a fixed current to temperature sensing element 168 and monitors a resulting voltage level to determine a current temperature 204 of the column of fluid chambers 162. In one example, as illustrated, the temperature represents an average temperature of the column of fluid chambers 162. In one example, temperature sensor 202 stores the current temperature 204 in a memory or register. In one example, as will be described in greater detail below, warming controller 200 further includes a default temperature setpoint 206 and a warming temperature setpoint 208. According to one example, as will be described in greater detail below, warming controller 200 provides a warming enable signal via a warming enable line 212.

Fluid ejection device 114 further includes activation logic 210 for energizing firing mechanisms 160 of the nozzles 158 and pumps 156 of the column of fluid chambers 162 based on address data on address bus 184, on firing data on the plurality of data lines D1 to DM, and on a state of the warming enable signal on warming signal line 212. In the illustrated example, each fluid chamber 150 of each primitive (i.e., pumps 156, nozzles 156) includes a firing resistor (illustrated as firing resistor 160-1 to 160-N) coupled between a power line 214 and a ground line 216 via a controllable switch 218, such as a field effect transistor (illustrated as FETs 218-1 to 218-N). Additionally, for each primitive P1 to PM, each pump 156 and nozzle 158 includes an address decoder 220 for the corresponding address (illustrated as address decoders 220-1 to 220-N), a multiplexer (MUX) 222 (illustrated as multiplexers 222-1 to 222-N), and an AND-gate 224 (illustrated as AND-gates 224-1 to 224-N).

For each pump 156 and nozzle 158, the corresponding address encoder 220 is coupled to address bus 184, with fire pulse line 192 and warming pulse line 194 being inputs to multiplexer 222, and with the corresponding data line 188 and warming enable line 212 being control inputs to multiplexer 222. The output of multiplexer 222 and the output of address decoder 220 serve as inputs to AND-gate 224, with the output of AND-gate 224 being connected to and controlling the gate of control switch 218.

In operation, according to one example, electronic controller 110 receives data 124 for an ejection job from a host (e.g., a computer), the data being representative of a desired image to be printed (e.g., a document or graphic). In one example, based on data 124, electronic controller 110 provides energization or firing data to fluid ejection device 114 in the form of a series NCGs (nozzle column groups) which cause the firing mechanisms of pumps 156 and nozzles 158 to function to eject a pattern of fluid drops to form the desired image (such as on a print media, for example). In one another case, electronic controller 110 receives the series of NCGs from the host device.

Figure 5:
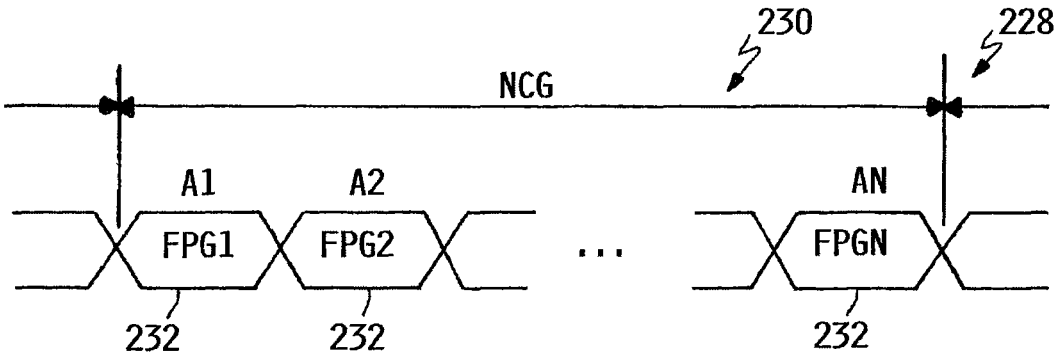
FIG. 5 is a block and schematic diagram generally illustrating a series of nozzle column groups including fire pulse groups, according to one example.

FIG. 5 is a block diagram generally illustrating an example of a portion of a series 228 of NCGs 230 of an ejection job, with each NCG 230 including a series of FPG (fire pulse groups) 232. In one example, each NCG 230 includes a series of N FPGs 232, with each FPG 232 corresponding to a different one of the set of addresses, A1 to AN, of a primitive (see FIG. 3, for example). Although the FPGs 232 are illustrated as being arranged sequentially in order from address A1 to AN, the FPGs can be arranged in any number of different orders.

Figure 6:
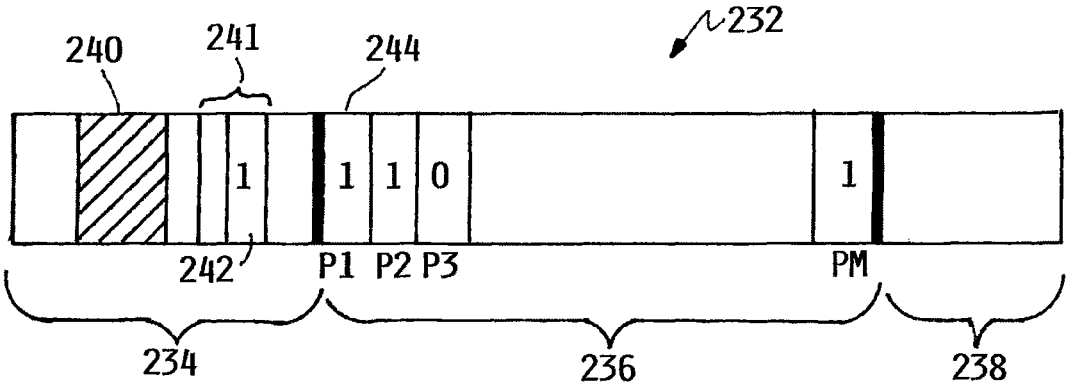
FIG. 6 is a block diagram illustrating generally an example of a fire pulse group, according to one example.

FIG. 6 is a block diagram generally illustrating an FPG 232, in accordance with one example of the present disclosure. FPG 232 includes a header portion 234, an energization or firing data portion 236, and a footer portion 238. According to one example, header portion 234 includes address bits 240 indicative of the address of the set of addresses A1 to AN to which the FPG corresponds. As will be described in greater detail below, header portion 234 further includes warming operations data 241, including a warming bit 242, in accordance with the present disclosure, having an enabling value (e.g., a value of "1") or a disabling value (e.g., a value of "0") set by warming monitor 170. In one example, warming operations data 241 may include other information such as timing data, for instance. Although described herein for ease of description as a warming bit, in other examples, warming bit 242 may comprise warming data including more than one bit and, as such, have more than a binary value.

In one example, firing data portion 236 includes a series of firing bits 244, where each firing bit 244 corresponds to a different one of the primitives P1 to PM such that each firing bit 244 of the series of fire bits corresponds to a fluid chamber 150 at the address represented by address bits 240 in a different one of the primitives P1 to PM. In one example, each firing bit 244 has a firing value (e.g., a value of "1") or a non-firing value (e.g., a value of "0"). As described in greater detail below, a firing bit 244 having a value of "1" causes the firing resistor 160 at the corresponding address in the corresponding primitive to be energized or "fired" to eject a fluid drop in the case of a nozzle 158 or fluid being recirculated in the case of a pump 156, while a value of "0" results in no energization of firing resistors.

Returning to FIG. 4, according to one example, after assembling or receiving the series of NCGs 228 for a given ejection job, warming monitor 170 requests the current temperature 204 of the column of fluid chambers 162 from warming controller 200, such as via a communication path 205 (e.g., a serial I/O communication path). In one example, warming monitor 170 adds the offset temperature value 174 to the current temperature 204 and compares the sum to the maximum temperature setpoint 172, where the maximum temperature setpoint 172 is a maximum operating temperature for the column of fluid chambers 162. If the sum of current temperature 204 and offset temperature value 174 is greater than the maximum temperature setpoint 172, warming monitor 170 sets (or leaves) the value of warming bit 242 in each PCG 232 of each NCG 230 of the series of NCGs 228 at the disable value (e.g., at a value of "0"), and communicates the series of NCGs 228 for the given ejection job to fluid ejection device 114 via a communication path 207.

If the sum of current temperature 204 and offset temperature value 174 is less than the maximum temperature setpoint 172, warming monitor 170 analyzes the value of each firing bit 244 of each FPG 232 of each NCG 230 of the series NCGs 228 which corresponds to a pump 156 to determine a firing profile for each pump 156 (i.e., when the pumps will be pumping) for the given ejection job. In one example, based on such firing profiles, warming monitor 170 identifies pending zones of heavy recirculation of the column of fluid chambers 162 that will become elevated in temperature relative to other zones of the column of fluid chambers 162 during the ejection job and which will undesirably result in the ejection of fluid drops of different sizes.

According to one example, when generating FPGs 232 for an ejection job, a nozzle 158 is identified as requiring pumping by an associated pump 156 if the nozzle has been idle (i.e., has not ejected fluid) for a specified time period (e.g. 1 second), and if the nozzle is to eject fluid based on ejection data corresponding to the nozzle. When a nozzle 158 is identified as requiring pumping, firing bits for pump(s) 156 associated with the identified nozzle(s) 158 are set with the fire enable value (e.g., a value of "1") so that the pump(s) 156 are "pumped" a predetermined number of times prior to when the associated nozzle 158 is to be fired to eject fluid drops. In one example, the pump(s) 156 are pumped a predetermined number of times, such as in a range from 100 to 1,000 times, for instance. In one example, a pump 156 is pumped 500 times, for instance.

In one example, warming monitor 170 defines a region of heavy recirculation as being a predetermined portion of the column of nozzles 162 (say $1/4^{th}$ of the column of fluid chambers 162, for example) where at least a predetermined percentage of pumps 156 in the predetermined portion (say 50% of pumps 156, for example) will be simultaneously pumping for a predetermined duration (say 500 consecutive NCGs 230, or 5 mS, for example). In one example, the predetermined portion of the column of nozzles 162 may be a number of physically adjacent primitives, such as three consecutive primitives, for instance. In one example, the predetermined portion of the column of nozzles 162 is a "sliding window" of a certain dimension, such as a sliding window having a width of $1/4^{th}$ a length of the column of nozzles 162, so that a pending zone of heavy recirculation may be any group of physically adjacent pumps 156 along the length of the column of nozzles 162. In one example, the sliding windows has a width equal to a number of primitives, such as 3 primitives for example, so that an identified pending zone of heavy recirculation may be any group of 3 consecutive primitives, for instance.

In one example, when warming monitor 170 identifies a pending zone of heavy recirculation of pumps 156, warming monitor 170 sets warming bit 242 to the enable value (e.g., a value of "1") in selected PCGs 232 of NCGs 230 of the series of NCGs 228.

In one example, warming monitor 170 sets warming bit 242 to the enable value in each PCG 232 of a selected number of consecutive NCGs 230. In one example, the selected number of consecutive NCGs 230 in which warming monitor 170 sets the warming bit coincides with the consecutive NCGs 230 corresponding to the pending zone of heavy recirculation. In one example, the selected number of consecutive NCGs in which warming monitor 170 sets the warming bit is greater than the consecutive number of NCGs 258 of the pending zone of heavy recirculation and precedes and overlaps the NCGs 230 of the pending zone of heavy recirculation in the series of NCGs 228.

Figure 7:
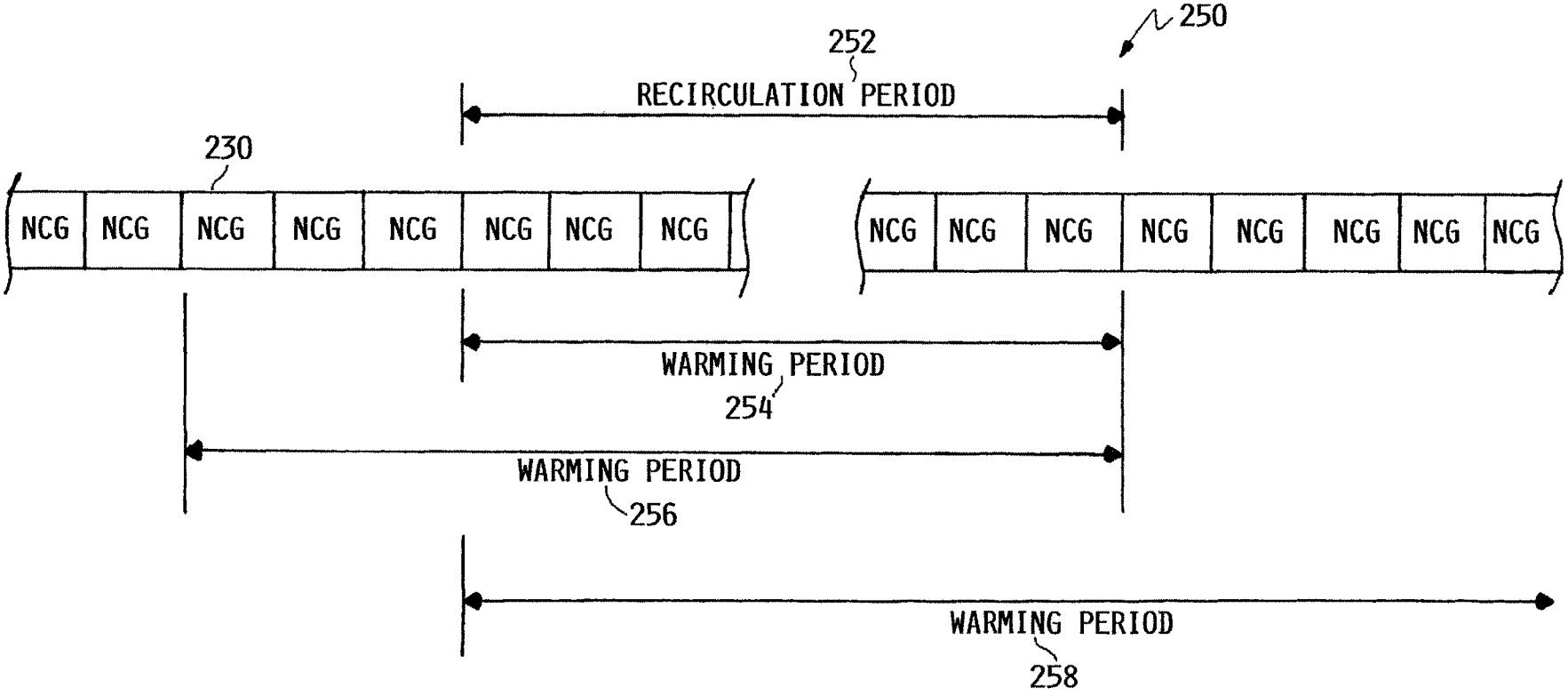
FIG. 7 is a block and schematic diagram generally illustrating an example of a portion of a series of nozzle column groups, according to one example.

FIG. 7 is a block and schematic diagram generally illustrating a series 250 of NCGs 230 for an example ejection job, where warming monitor 170 has identified a pending zone of heavy recirculation as occurring during heavy recirculation period covering a sub-series of NCGs 230, indicated at 252. In one example, in response to such identified pending zone of heavy recirculation period 252, warming monitor 170 sets the warming bit 242 to the enable value in selected FPGs of a sub-series of NCGs 230 of the series of NCGs 228 to define a warming period 254 which coincides with the heavy recirculation period 252. In another example, warming monitor 170 sets the warming bit to the enable value in each FPG of a sub-series of NCGs 230 to define a warming period 256 which precedes and encompasses heavy recirculation period 252. In another instance, warming monitor 170 sets the warming bit 242 to the enable value in a sub-series of NCGs 230 coinciding with a beginning of the heavy recirculation period 252 and extending to an end of the series of NCGs 228 (i.e., the end of the ejection job) as indicated at 258.

With reference to FIG. 4, after warming monitor 170 sets the warming bits 242 in selected NCGs 232, warming monitor 170 communicates the sum of the current temperature 204 and the offset temperature value 174 to warming controller 200 as warming setpoint temperature 208, and electronic controller 110 communicates the series of NCGs 228 for the given ejection job to fluid ejection device 114 via a communication path 207.

In operation, input logic 180 receives the series of NCGs 228 and for each FPG 232 checks header 234 for the state of warming bit 242. In a first scenario, if warming bit 242 has the enable value (e.g., a value of "1"), input logic 192 provides warming operations data 241 to warming controller 200, such as via a data path 201. In one example, in response to receiving warming operations data at 201, warming controller 200 compares the current temperature 204 of the column of fluid chambers 162 to the warming setpoint temperature 208. In one example, when current temperature 204 is less than setpoint temperature 208 and at least equal to default temperature 206, warming controller 200 sets warming enable signal 212 to the enable value (e.g., a value of "1"). In contrast, when current temperature 204 is greater than setpoint temperature 208, warming controller 200 sets warming enable signal 212 to the disable value (e.g., a value of "0"). In one example, when warming operations data is not present at 201, warming controller 170 maintains warming signal 212 at the disable value.

Continuing with the above scenario, for each FPG 232, input logic 192 provides the address data associated with the FPG, such as address data 240 in header portion 234, to address encoder 182 which encodes the corresponding address onto address bus 184, and provides the firing bits 244 of firing data portion 236 to data buffer 186 which places each of the firing bits 244 onto its corresponding data line D1 to DM as indicated at 188.

The encoded address on address bus 184 is provided to each address decoder 220-1 to 220-N of each primitive P1 to PM, with each of the address decoders corresponding to the encoded address on address bus 184 providing an active output to the corresponding AND-gate 224. For example, if the encoded address from FPG 232 corresponds to address A1, address decoders 220-1 of each primitive will provide at active output to corresponding AND-gate 224-1.

Multiplexers 222-1 to 222-N of each primitive P1 to PM receive as inputs the fire pulse 192 and the warming pulse 194, and as control or select inputs warming enable signal 212 and the fire bit 244 on the corresponding one of the data lines D1 to DM. In one example, if firing data on the corresponding data line 188 has a firing value (e.g., has a value of "1"), multiplexer 222 outputs fire pulse 192 to the corresponding AND-gate 224 if the warming enable signal has either the enable value (e.g., a value of "1") or the disable value (e.g., a value of "0"). In one example, if firing data on the corresponding data line 188 has a non-firing value (e.g., has a value of "0"), multiplexer 222 outputs warming pulse 194 to the corresponding AND-gate 224 if the warming enable signal has the enable value (e.g., a value of "1") and provides no output to the corresponding AND-gate 224 if the warming enable signal has the disable value (e.g. a value of "0").

Figure 10A:
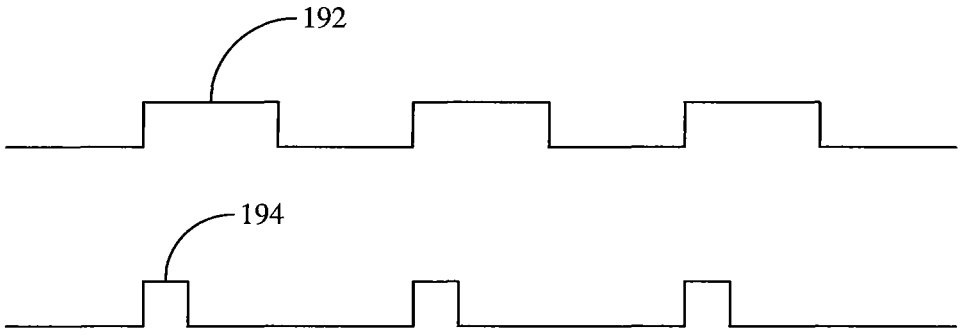
FIG. 10A is a timing diagram generally illustrating examples of a warming pulse and a firing pulse, according to one example.

In the above example, pulse generator 190 is described as providing separate fire pulse and warmings pulse signals 192 and 194 which are selected by multiplexers 222 based on selection inputs thereto (e.g. data input and warming enable signal). FIG. 10A is a timing diagram generally illustrating one example of fire pulse and warming pulses signals 192 and 194. As illustrated, warming pulse signal 194 has a duration that causes energization of a firing mechanism without casing fluid to be circulated in the case of a pump 156 or a fluid drop to be ejected in the case of a nozzle 156, while fire pulse signal 194 has a longer duration that causes recirculation and fluid drop ejection.

Figure 10B:
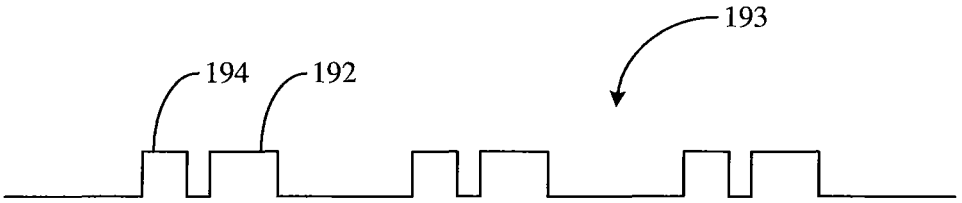
FIG. 10B is a timing diagram generally illustrating an example of pulse signal including a warming pulse and a firing pulse, according to one example.

In another example, as illustrated by FIG. 10B, fire pulse 192 and warming pulse 194 may be part of a same pulse train 193, where warming pulse 194 causes fluid to be warmed and fire pulse 192 subsequently causes fluid circulation or fluid drops to be ejected. With reference to FIG. 4, according to such an example, in lieu of multiplexers 222, other suitable logic (not illustrated) would be employed to provide both the warming pulse 194 and fire pulse 192 or only the warming pulse portion 194 based on data on the corresponding data line 188 and on warming enable signal 212.

Returning to FIG. 4 and the above scenario, where the address of the FPG 232 corresponds to address A1 and where the warming bit 242 in header portion 234 has the enable value (e.g., a value of "1"), if the firing bit 244 associated with primitive P1 has a non-firing value (e.g; a value of "0"), if the current temperature 204 is less than warming setpoint temperature 208, warming signal 212 will have an enable value (e.g., a value of "1") and multiplexer 222-1 will provide warming pulse 194 to firing resistor 160-1 via AND-gate 224-1 and switch 218-1, where warming pulse 194 will warm firing resistor 160-1 without resulting in recirculation of fluid. However, if the firing bit 244 associated with primitive PM has a firing value (e.g., a value of "1"), multiplexer 222-1 of primitive PM will provide fire pulse 192 to firing resistor 160-1 of primitive PM which will fire the firing resistor 160-1 and result in the recirculation of fluid. The same logic applies to all pumps and nozzles of the column of fluid chambers 162.

In the above scenario, for each FPG 232 of each NCG 230 of the series of NCGs 228 for an ejection job, when warming bit 242 has an enable value (e.g., a value of "1"), a fire pulse 192 will be provided to each firing resistor 160 when the corresponding address is present on address bus 184 and when the firing bit 244 on the corresponding data line 188 has a firing value (e.g., a value of "1"), and a warming pulse 194 will be provided to each firing resistor 160 when the corresponding address is present on address bus 184, when the firing bit 244 on the corresponding data line 188 has a non-firing value (e.g. a value of "0"), and current temperature 204 of the column of fluid chambers 162 is less than warming setpoint temperature 208. It is noted that, regardless of the value of warming bit 242, when the firing bit 244 on the corresponding data line 188 has a firing value (e.g., a value of "1"), fire pulse 192 will be provided to the firing resistor 160.

In one example, warming pulse 194 will be provided to each such firing resistor 160 until current temperature 204 reaches warming setpoint temperature 208, at which point warming signal 212 will be set to have a disable value (e.g., a value of "0") and thereby disable warming operations. In one example, warming pulse 194 will be provide to each such firing resistor 160 until current temperature 204 reaches warming setpoint temperature 208 or until the series of FPGs having the warming bit 242 set with the enable value (e.g., a value of "1") has been processed by fluid ejection device 114.

In one example, both non-circulating pumps 156 and non-firing nozzles 158 receive warming pulse 194 as described above. In such case, while zones of the column of fluid chambers 162 outside of the identified pending zone of heavy recirculation will be warmed to warming set-point temperature 208, non-firing nozzles 158 included within the heavy zone of recirculation will also be warmed, thereby further warming the identified zone of heavy recirculation.

In one example, when a pending zone of heavy recirculation is identified by warming monitor 170, warming monitor 170 sets warming bit 242 to the enable value (e.g., a value of "1") in only those FPGs 232 having addresses corresponding to pumps 156. For example, with reference to FIGS. 3B and 4, pumps 156 are arranged at odd numbered addresses (A1, A3, . . . A(N−1)) while nozzles 158 are arranged at even numbered addresses (A2, A4, . . . AN). According to one example, warming monitor 170 sets warming bit 242 to the enable value only in FPGs 232 corresponding to odd numbered addresses so that only pumps 156 are warmed. In such case, only pumps 156 in zones of the column of fluid chambers 162 outside of the identified zone of heavy recirculation will receive warming pulse 194.

In other examples, warming monitor 170 may set warming bits 242 to have the enable value in an alternating fashion between odd and even numbered addresses so that warming pulse 194 is alternatingly provided to non-circulating pumps 156 and non-ejecting nozzles 158 in order to more even out energy provided to such pumps and nozzles. Any number of scenarios may be employed depending on the arrangement of the pumps 156 and nozzles 158 on fluid ejection device 114.

Figure 8B:
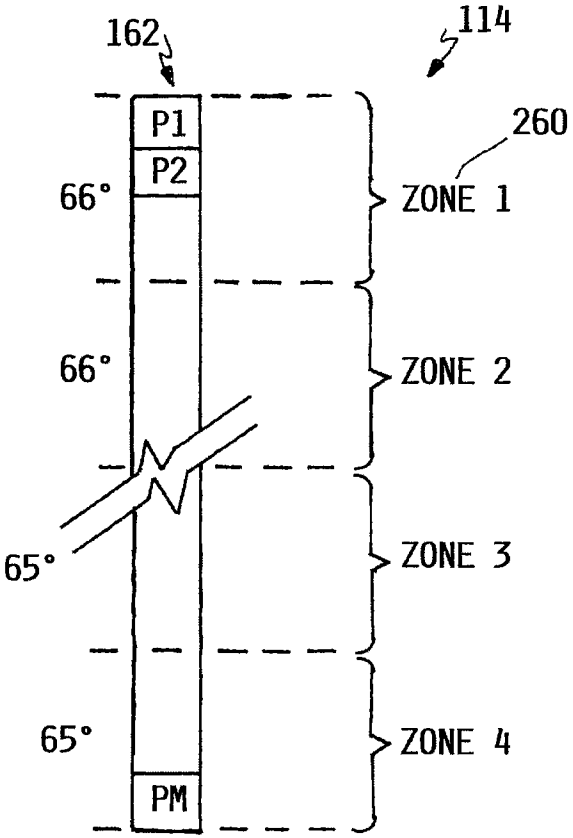
FIG. 8B is block diagram generally illustrating an example of a column of primitives, according to one example.
Figure 8A:
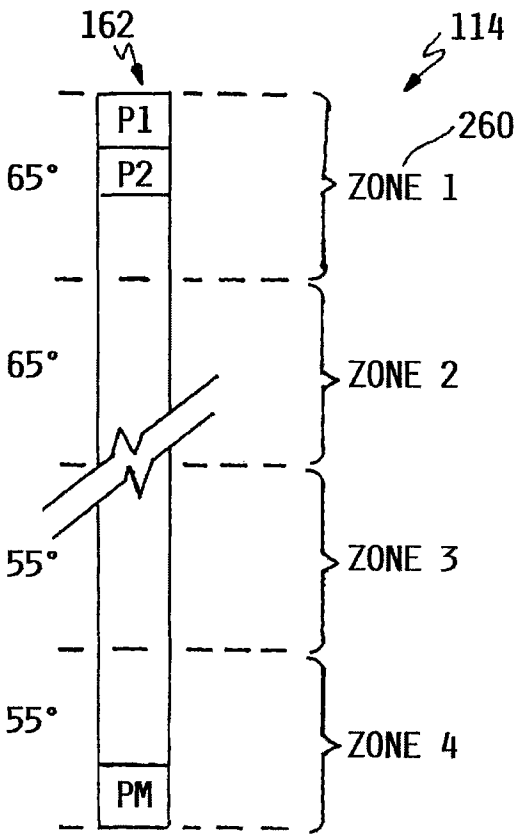
FIG. 8A is block diagram generally illustrating an example of a column of primitives, according to one example.

FIGS. 8A and 8B are block and schematic diagrams respectively illustrating a column 162 of fluid chambers during an ejection job, where FIG. 8 shows illustrative temperature without a warming system in accordance with the present disclosure, and FIG. 8B shows illustrative temperatures with a warming system in accordance with the present disclosure. In each case, column 162 is arranged into a plurality of primitives P1 to PM and defined as having four zones 260.

With reference to FIG. 8A, without a warming system in accordance with the present disclosure, zones 3 and zone 4 represent zones where nozzles 158 are ejecting fluid drops without recirculation by pumps 156, where the ejection of such fluid drops causes the temperature to be at a temperature of 55° C., for example (e.g., an operational default temperature 206 of fluid ejection device 114). In contrast, zones 1 and 2 represent zones which had previously been inactive, but where pumps 156 are recirculating fluid in preparation for ejecting, and where such recirculation has caused the temperature to rise to 65° C., for example. While an average temperature of column 162 of FIG. 8A is 60° C., a temperature gradient of 10° C. between zones 1-2 and zones 3-4 will result in thermal banding in the printed image between such zones.

With reference to FIG. 8B, employing a warming system in accordance with the present disclosure, prior to actual recirculation of fluid by pumps 156 within zones 1 and 2, zones 1 and 2 are identified as pending zones of heavy recirculation, such as by warming monitor 170 with warming bits 242 being set to the enable value in selected PCGs 232 as described above. For instance, in one example, warming bits 242 are set to the enable value only for PCGs 232 having addresses corresponding to only pumps 156. In the illustrated example, an average temperature of the column 162 of fluid chambers prior to the ejection job is illustrated as having been 55° C., with warming monitor 170 employing an offset temperature value 174 such that warming setpoint temperature 174 is at 65° C.

As illustrated, in response to the warming bit being set to the enable value in PCGs with addresses corresponding to pumps 164, warming pulses 194 provided to firing resistors 160 of non-circulating pumps 156 warms zones 3 and 4 to the warming setpoint temperature of 65° C. While warming pulses 194 provided to non-circulating pumps 156 in zones 1 and 2 of heavy recirculation also raises the temperature of such zones, to 66° C., for instance, temperature gradients between zones 1-2 and zones 3-4 are greatly reduced, thereby substantially reducing or eliminating thermal banding in the printed image between such zones. After the ejection job is completed, or after the period of heavy recirculation has been processed, the column of fluid chambers 162 of fluid ejection device 114 are no longer warmed through the use of warming pulses 194 such that column 162 is maintained at default temperature 206 (e.g., 55° C.), such as by other warming means, for example.

Returning to FIG. 4, it is noted that in the case where warming bit 242 of a FGP 232 does not have the enable value, a fire pulse 192 is provided to resistors 160 of pumps 156 and nozzles 158 based on the whether the corresponding address is present on address bus 184 and on the value of the firing bit 244 on the corresponding data line 188. Additionally, although illustrated by FIG. 4 with respect to a single column 162 of pumps 156 and nozzles 158, it is noted that the operation and illustrative arrangement can be applied to a configuration including any number of columns or other arrangements.

Figure 9:
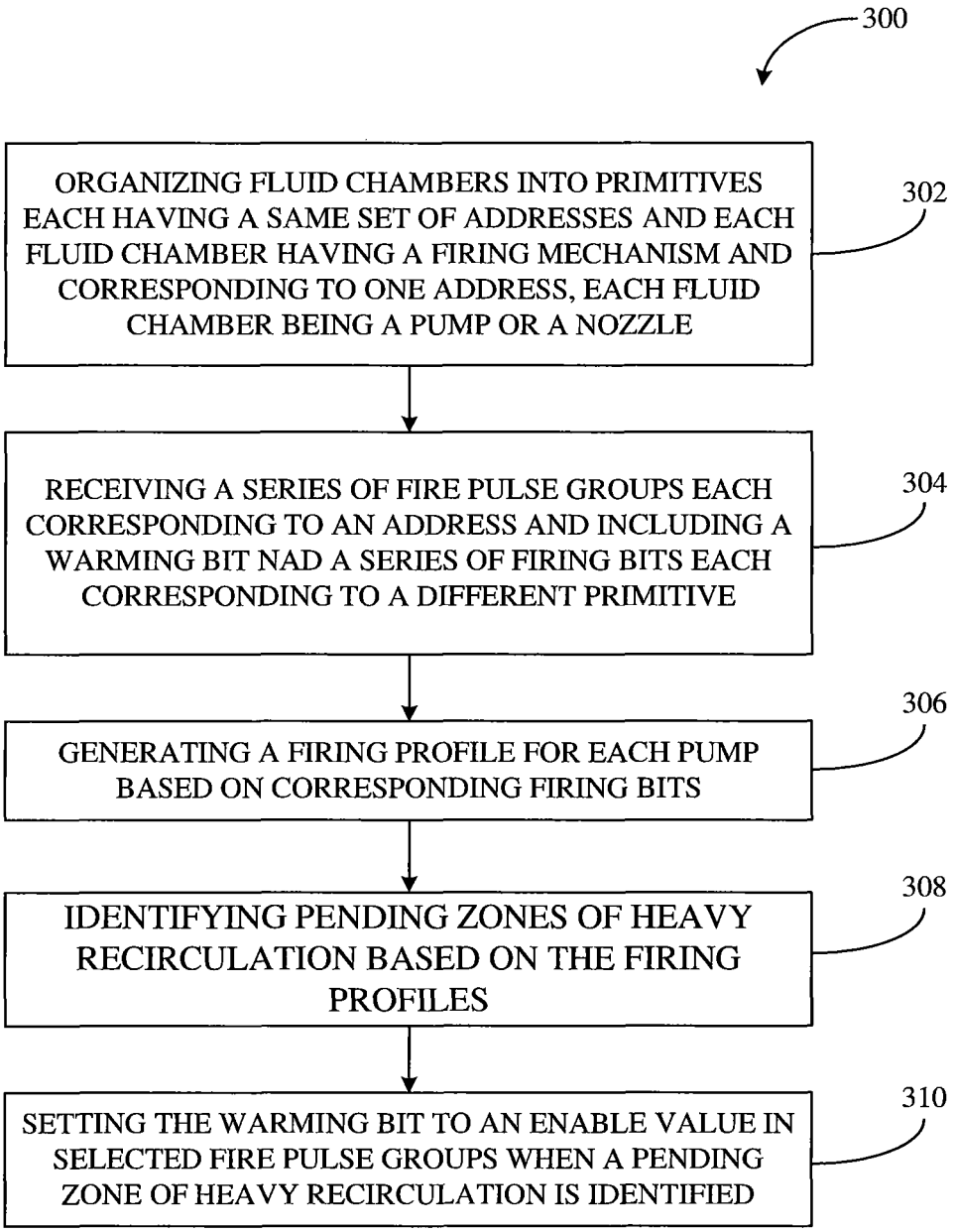
FIG. 9 is a flow diagram generally illustrating a method of operating a fluid ejection device, according to one example.

FIG. 9 is a flow diagram generally illustrating a method 300 of operating a fluid ejection system, such as a fluid ejection system 100 including a fluid ejection device, such as fluid ejection device 114, according to one example of the present disclosure. At 302, method 300 includes organizing a plurality of fluid chambers into a number of primitives with each primitive having a same set of addresses, such as fluid chambers 150 (e.g., ink chambers) being organized into a plurality of primitives 164 (e.g., primitives P1 to PM) having set of addresses 166 (e.g., addresses A1 to AN) as illustrated by FIGS. 3A, 3B, and 4. Each fluid chamber of a primitive includes a firing mechanism and corresponding to a different address of the set of addresses, with each fluid chamber being one of a pump and a nozzle, such as fluid chambers 150 including a firing mechanism 160 and corresponding to a different one of the addresses A1 to AN and being one of a pump 156 and a nozzle 158, as illustrated by FIGS. 3B and 4, for example.

At 304, method 300 includes receiving series of FPGs, with each FPG corresponding to an address of the set of addresses and including a warming bit having a disable value and a series of firing bits, each firing bit corresponding to a different one of the primitives and having a firing value and a non-firing value, such as the series 230 of FPGs 232 corresponding to one of the addresses A1 to AN, with each FPG 232 including a warming bit 242 and a series of firing bits 244 with each firing bit 244 having a firing value (e.g., a value of "1") and a non-firing value (e.g., a value of "0"), such as illustrated by FIGS. 5 and 6, for example.

At 306, method 300 includes generating a firing profile for each pump of each primitive based on values of corresponding firing bits of corresponding fire pulse groups, such as warming monitor 170 generating a firing profile for each pump 156 of each primitive P1 to PM based on corresponding firing bits 244 of corresponding fire pulse groups 232 as described by FIG. 4 with respect to warming monitor 170. At 308, pending zones of heavy recirculation are identified, if present, based on the firing profiles generated at 306, such as firing profiles generated by warming monitor 170 as described with respect to FIG. 4 above.

At 310, method 300 includes setting the warming bit to have an enable value in selected FPGs when a pending zone of heavy recirculation is identified, such as warming monitor 170 setting warming bit 242 of selected FPGs 232 to the enable value (e.g., a value of "1") when a zone of heavy recirculation is defined as described with respect to FIG. 4 above, and as illustrated by examples of selected groups 254, 256, and 258 of FGPs 232 having warming bits 242 set to the enable value in response to identified zone of heavy recirculation 252 as illustrated by FIG. 7.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection device comprising:

a plurality of primitives, each primitive to receive a same set of addresses and each including:

a plurality of fluid chambers, each fluid chamber corresponding to a different address of the set of addresses and including a firing mechanism;

input logic to receive a series of fire pulse groups, each fire pulse group corresponding to an address of the set of addresses and including warming data having an enable value or a disable value and a series of firing bits, each firing bit corresponding to a different one of the primitives and having a firing value or a non-firing value; and activation logic, for each fire pulse group, for each firing bit, when the warming data has the enable value, to provide a warming pulse to the firing mechanism of the fluid chamber corresponding to the firing bit when the firing bit has the non-firing value and a temperature of the plurality of primitives is at least equal to a default temperature and less than a warming temperature.

2. The fluid ejection device of claim 1, the activation logic, for each firing bit of each fire pulse group, when the warming data has the enable value, to providing a firing pulse to the firing mechanism of the fluid chamber corresponding to the firing bit when the firing bit has the firing value.

3. The fluid ejection device of claim 1, the activation logic, for each firing bit of each fire pulse group, when the warming data has the disable value, to providing a firing pulse to the firing mechanism of the fluid chamber corresponding to the firing bit when the firing bit has the firing value.

4. The fluid ejection device of claim 1, the firing mechanism of the fluid chambers comprising a thermal firing mechanism.

5. The fluid ejection device of claim 1, the fluid ejection device comprising an inkjet printhead.

6. A fluid ejection system comprising:

a fluid ejection device including:

a plurality of primitives, each primitive to receive a same set of addresses and each including:

a plurality of fluid chambers, each fluid chamber corresponding to a different address of the set of addresses and including a firing mechanism, each fluid chamber being one of a pump and a nozzle;

input logic; and activation logic; and a warming monitor to receive a series of fire pulse groups, each fire pulse group corresponding to an address of the set of addresses and including a warming data having a disable value and a series of firing bits, each firing bit corresponding to a different one of the primitives and having a firing value or a non-firing value, the warming controller to:

determine a firing profile for each pump of each primitive based on values of corresponding firing bits of corresponding fire pulse groups;

identify pending zones of heavy recirculation based on the firing profiles; and set the warming data to an enable value in selected fire pulse groups when at least one pending zone of heavy recirculation is identified.

7. The fluid ejection system of claim 6, the input logic to receive the series of fire pulse groups from the warming monitor; and the activation logic, for each fire pulse group, for each firing bit, when the warming data has the enable value, to provide a warming pulse to the firing mechanism of the fluid chamber corresponding to the firing bit when the firing bit has the non-firing value and a temperature of the plurality of primitives is at least equal to a default temperature and less than a warming temperature.

8. The fluid ejection system of claim 7, the warming monitor including an offset temperature value, the warming monitor to provide the warming temperature to the fluid ejection device, the warming temperature being a sum of the offset temperature value and a temperature of the plurality of primitives when the warming monitor receives the series of fire pulse groups, the warming temperature being less than a predefined maximum temperature.

9. The fluid ejection system of claim 6, the selected fire pulse groups being all fire pulse groups of the series of fire pulse groups.

10. The fluid ejection system of claim 6, the selected fire pulse groups being only fire pulse groups corresponding to fluid chambers which are pumps.

11. A method of operating a fluid ejection device including:

organizing a plurality of fluid chambers of the fluid ejection device into a number of primitives, each primitive having a same set of addresses, each fluid chamber of a primitive including a firing mechanism and corresponding to a different address of the set of addresses, each fluid chamber being one of a pump and a nozzle;

receiving a series of fire pulse groups, each fire pulse group corresponding to an address of the set of addresses and including a warming data having a disable value and a series of firing bits, each firing bit corresponding to a different one of the primitives and having a firing value or a non-firing value;

determining a firing profile for each pump of each primitive based on values of corresponding firing bits of corresponding fire pulse groups;

identifying pending zones of heavy recirculation based on the firing profiles;

setting the warming data to have an enable value in selected fire pulse groups when a pending zone of heavy recirculation is identified.

12. The method of claim 11, including:

for each fire pulse group, for each firing bit, when the warming data has the enable value, to provide a warming pulse to the firing mechanism of the fluid chamber in the corresponding primitive at the corresponding address when the firing bit has the non-firing value and a temperature of the plurality of primitives is at least equal to a default temperature and less than a warming temperature.

13. The method of claim 11, the selected fire pulse groups being only fire pulse groups corresponding to fluid chambers which are pumps.

14. The method of claim 11, where a pending zone of heavy recirculation is defined as a predetermined number of pumps in a predefined physical region of the fluid ejection device having corresponding firing bits having the firing value for a predetermined duration.

15. The method of claim 14, where the predefined physical region comprises a predefined number of adjacent primitives, the predetermined number of pumps comprises at least a predefined percentage of pumps in the predefined number of adjacent primitives, and the predetermined duration comprises a predefined number of consecutive firing bits.

* * * * *